US005163858A

United States Patent [19]

Sumrall

[11] Patent Number: 5,163,858

[45] Date of Patent: Nov. 17, 1992

[54] RESCUE BUOY APPARATUS

[76] Inventor: Randall M. Sumrall, 28625 25th Pl. South, A102, Federal Way, Wash. 98003

[21] Appl. No.: 754,638

[22] Filed: Sep. 4, 1991

[51] Int. Cl.[5] ..... B63B 22/08

[52] U.S. Cl. ..... 441/7; 441/11; 441/13

[58] Field of Search ..... 441/1, 13, 16, 2, 6, 441/7, 8, 9, 10, 11, 12, 14, 15, 30, 80, 88

[56] References Cited

U.S. PATENT DOCUMENTS 3,618,150 11/1971 Anselmi ..... 441/16
3,981,036 9/1976 Higgs ..... 441/2
4,702,715 10/1987 Winick ..... 441/6
4,784,626 11/1988 DeLaro ..... 441/7
4,896,620 1/1990 Jones ..... 441/16
4,932,910 6/1990 Hayday ..... 441/16
4,981,453 1/1991 Krishan et al. ..... 441/16
5,066,256 11/1991 Ward ..... 441/16

*Primary Examiner*—Jesûs D. Sotelo
*Assistant Examiner*—Stephen P. Avila
*Attorney, Agent, or Firm*—Leon Gilden

[57] ABSTRACT

A buoy member includes a central cavity with a weighted bottom portion to maintain alignment of the buoy apparatus, and the buoy apparatus includes a transmitter operative upon the buoy being projected from an associated boat. The buoy apparatus is further arranged to include a visible signal member inflated upon actuation of switching interiorly of the buoy, as well as a signal light. A spool brake is arranged to provide for controlled descent of the control tether mounted to the associated boat or individual.

6 Claims, 6 Drawing Sheets

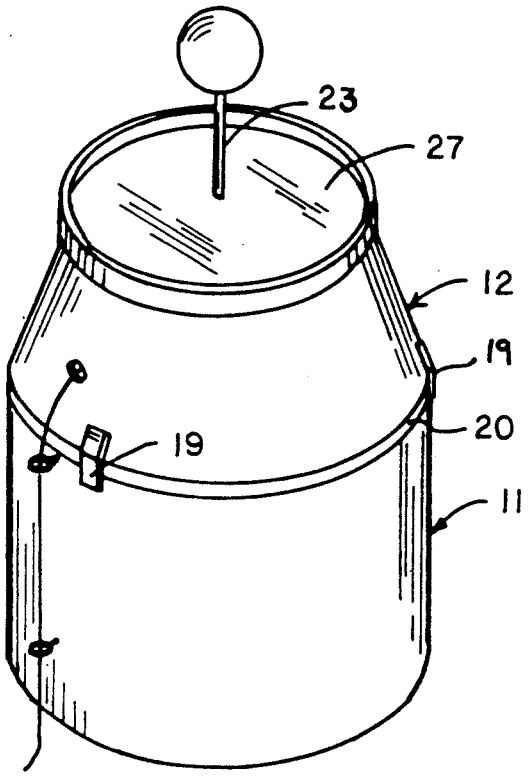
Fig 1
Fig 2
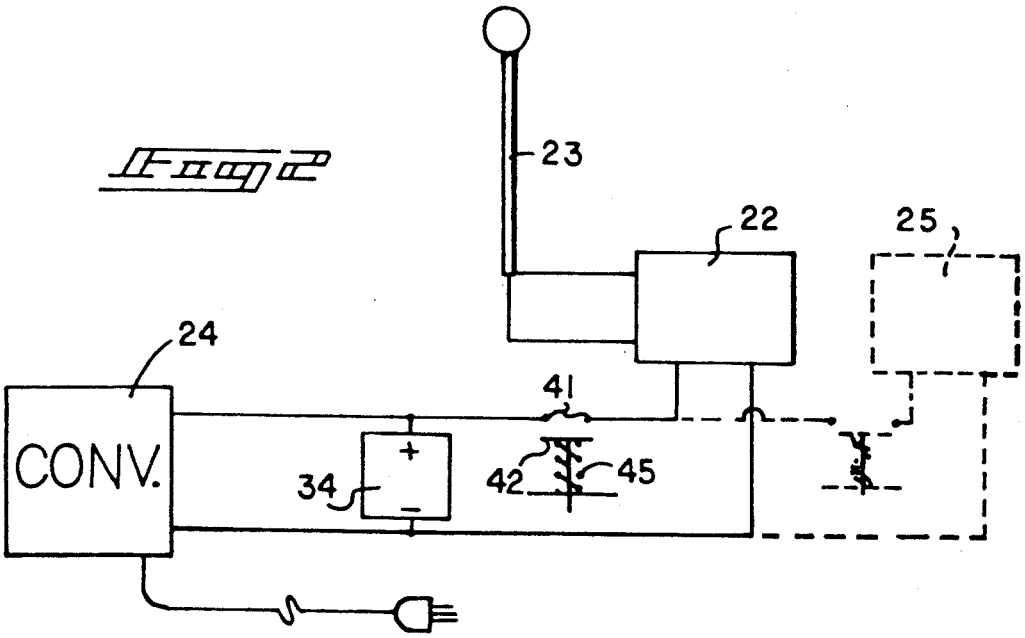

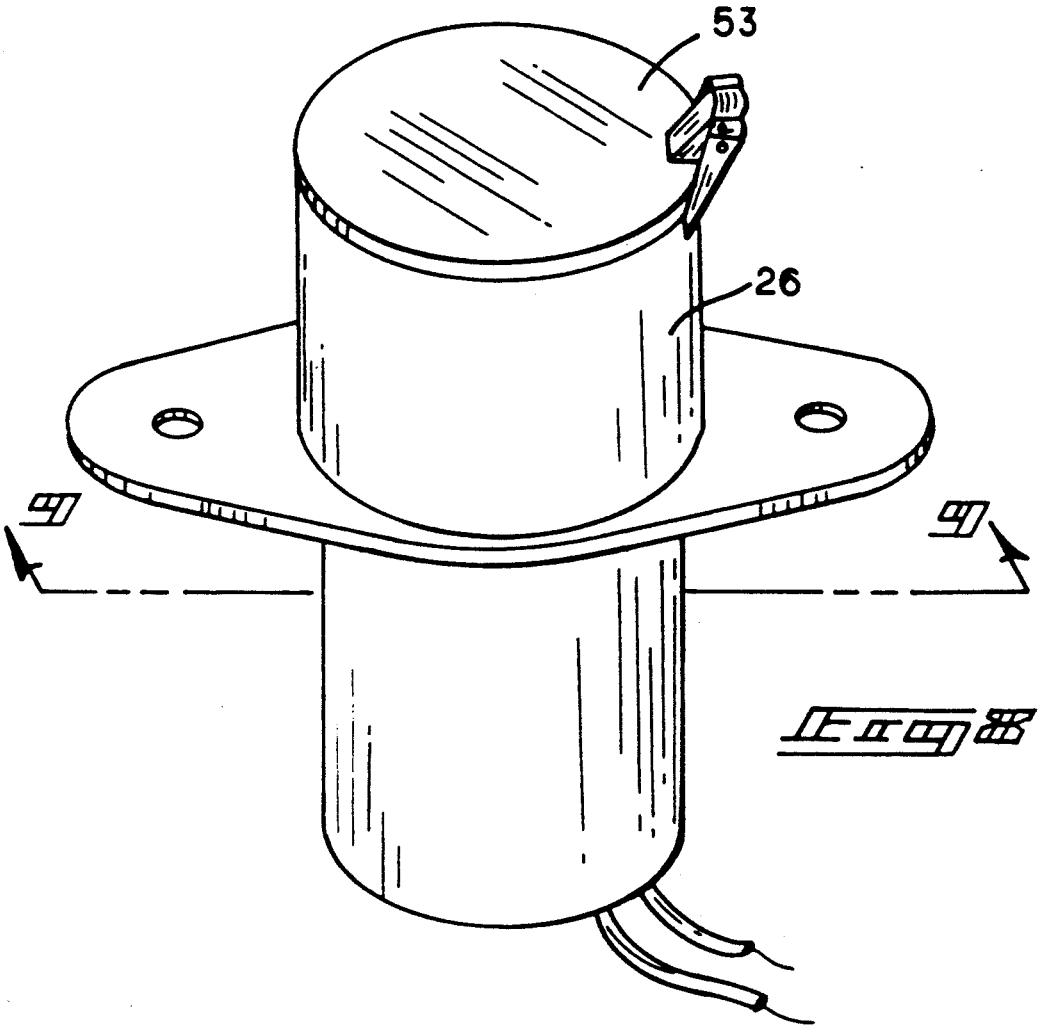
Fig 8
Fig 9
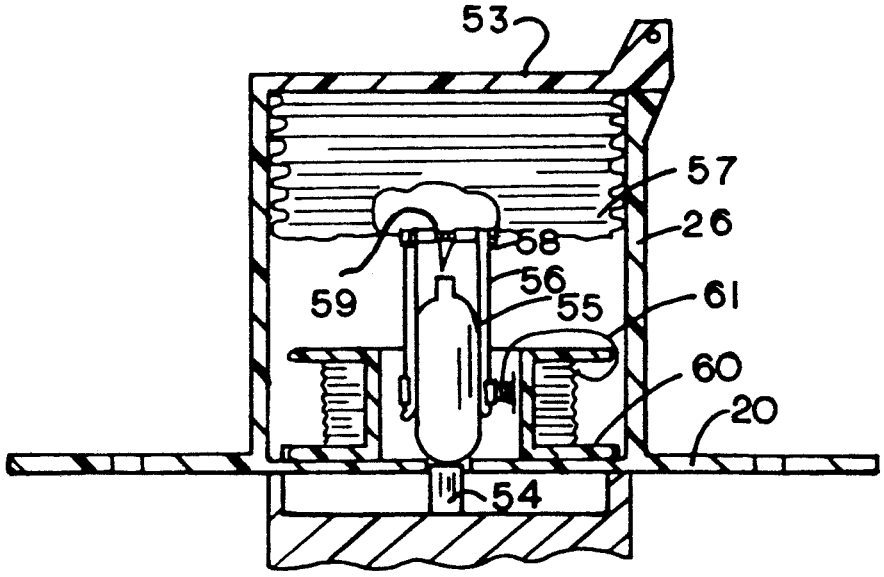

Fig 11 III

RESCUE BUOY APPARATUS

BACKGROUND OF THE INVENTION

1. Field of the Invention

The field of invention relates to signal apparatus, and more particularly pertains to a new and improved rescue buoy apparatus wherein the same is arranged to provide audible and visual signalling relative to an emergency situation.

2. Description of the Prior Art

Buoy structure is presented in the prior art for signalling relative to emergency situations. Such apparatus is exemplified in U.S. Pat. No. 3,981,036 to Higgs wherein a buoy includes a radio, as well as visual signal relative to the buoy structure.

U.S. Pat. No. 4,784,626 to Delaro sets forth a buoy including a radio transmitter attachable to a super structure of a vehicle for subsequent reference in relocating a sunken vehicle.

U.S. Pat. No. 4,702,715 to Winick sets forth a rescue apparatus utilizing an inflation assembly and portable battery power transmitter worn by an individual relative to a life jacket.

As such, it may be appreciated that there continues to be a need for a new and improved rescue buoy apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of buoy apparatus now present in the prior art, the present invention provides a rescue buoy apparatus wherein the same utilizes a plurality of visual and audible signal means for location of an individual in an emergency rescue procedure. As such, the general purpose of the present invention, which will be described subsequently in greater detail, is to provide a new and improved rescue buoy apparatus which has all the advantages of the prior art buoy apparatus and none of the disadvantages.

To attain this, the present invention provides a buoy member including a central cavity, with a weighted bottom portion to maintain alignment of the buoy apparatus, and the buoy apparatus including a transmitter operative upon the buoy being projected from an associated boat. The buoy apparatus is further arranged to include a visible signal member inflated upon actuation of switching interiorly of the buoy, as well as a signal light. A spool brake is arranged to provide for controlled descent of the control tether mounted to the associated boat or individual.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved rescue buoy apparatus which has all the advantages of the prior art buoy apparatus and none of the disadvantages.

It is another object of the present invention to provide a new and improved rescue buoy apparatus which may be easily and efficiently manufactured and marketed.

It is a further object of the present invention to provide a new and improved rescue buoy apparatus which is of a durable and reliable construction.

An even further object of the present invention is to provide a new and improved rescue buoy apparatus which is susceptible of a low cost of manufacture with regard to both materials and labor, and which accordingly is then susceptible of low prices of sales to the consuming public, thereby making such rescue buoy apparatus economically available to the buying public.

Still yet another object of the present invention is to provide a new and improved rescue buoy apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of the instant invention.

FIG. 2 is a diagrammatic electrical illustration of the typical circuitry utilized by the invention.

FIG. 6 is an isometric illustration of an A-C convertor utilized by the invention.

FIG. 9 is an orthographic view, taken along the lines 9—9 of FIG. 8 in the direction indicated by the arrows.

FIG. 10 is an isometric illustration of an illumination member utilized by the invention.

FIG. 12 is an orthographic view of the invention in use relative to a sunken water craft.

DESCRIPTION OF THE PREFERRED EMBODIMENT

Figure 3:
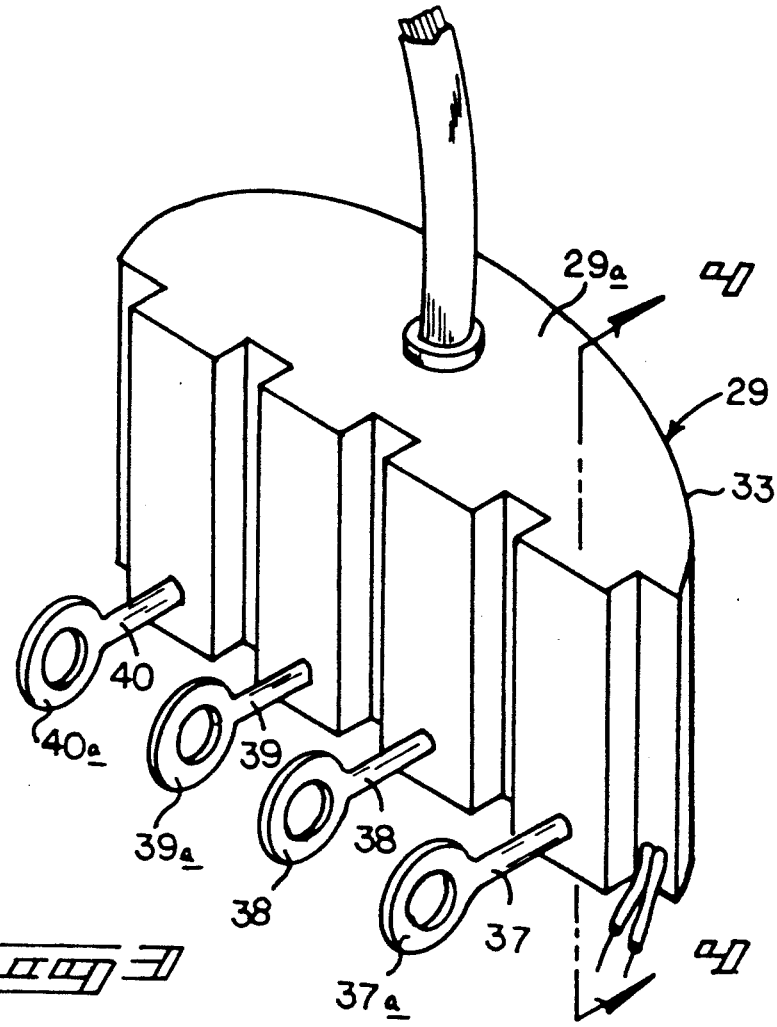
FIG. 3 is an isometric view of the switch means utilized by the invention.

With reference now to the drawings, and in particular to FIGS. 1 to 13 thereof, a new and improved rescue buoy apparatus embodying the principles and concepts of the present invention and generally designated by the reference numeral 10 will be described.

More specifically, the rescue buoy apparatus 10 of the instant invention essentially comprises a lower housing 11 securable in an upper housing 12, with the lower housing 11 including a lower housing weighted floor section 13 utilizing a component such as lead, mercury, and the like to stabilize the housing in use in a water or ocean environment, as illustrated in FIG. 12. The lower housing 11 includes a lower housing cavity 14 arranged to rotatably mount a spool 16 therewithin. An upper edge of the lower housing includes an upper edge resilient seal 15, wherein a lower edge resilient seal 21 is mounted to the lower edge of the upper housing 12. An intermediate floor plate 20 is mounted between the upper edge seal 15 and the lower edge seal 21 utilizing latch members 19 mounted about the periphery of the upper and lower edges of the lower and upper housings respectively to secure the housings together.

Figure 13:
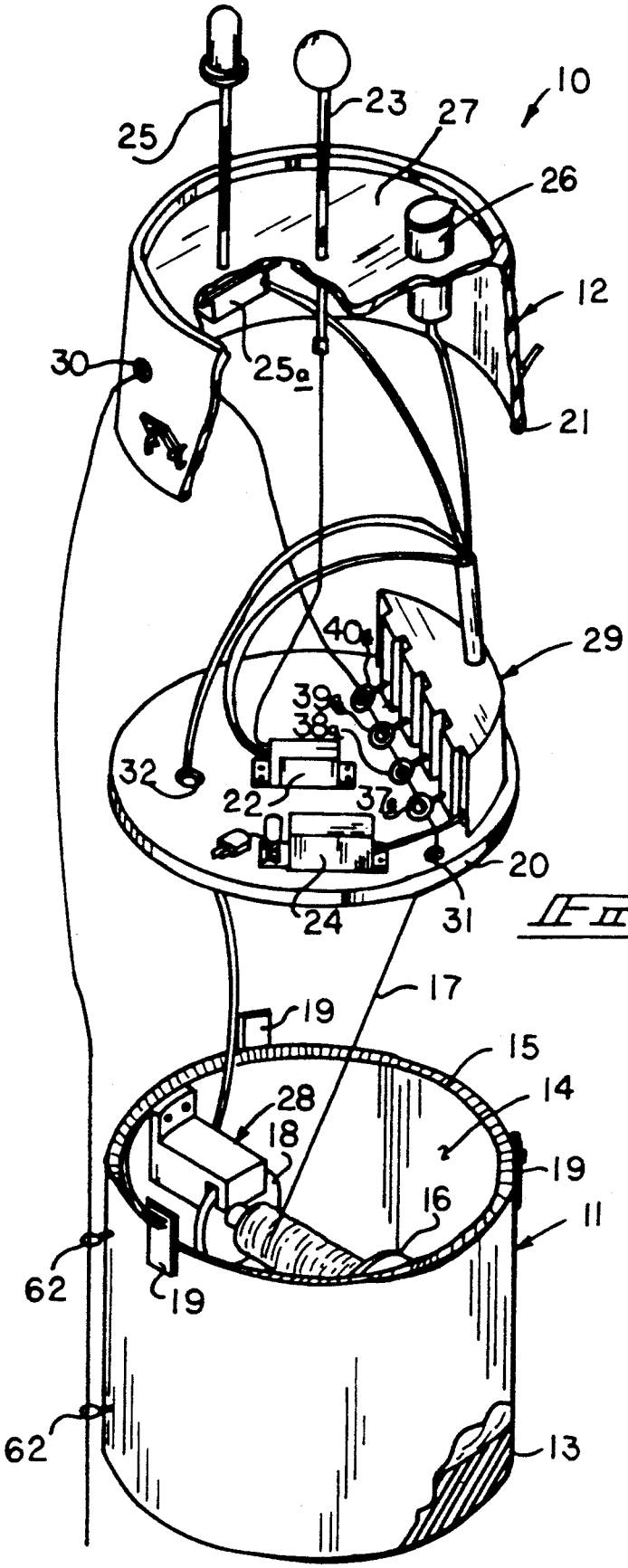
FIG. 13 is an isometric exploded illustration of the invention.

An elongate flexible tether line 17 is wound about the spool 16 and is directed through a tether line floor plate feed bore 31 through the floor plate and then through a tether line upper housing guide bore 30, as illustrated in FIG. 13 for example. A plurality of guide loops 62 are positioned in alignment underlying the tether line upper housing guide bore 30, with the tether line secured to a boat "B", as illustrated in FIG. 12. It is contemplated that the organization be mounted within a framework permitting release of the apparatus 10 upon an emergency situation such as a sinking of the boat, as illustrated in FIG. 12.

Figure 11:
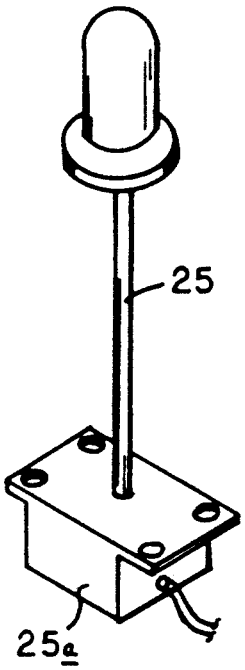
FIG. 11 is an isometric illustration of a spool brake utilized by the invention.
Figure 11I:
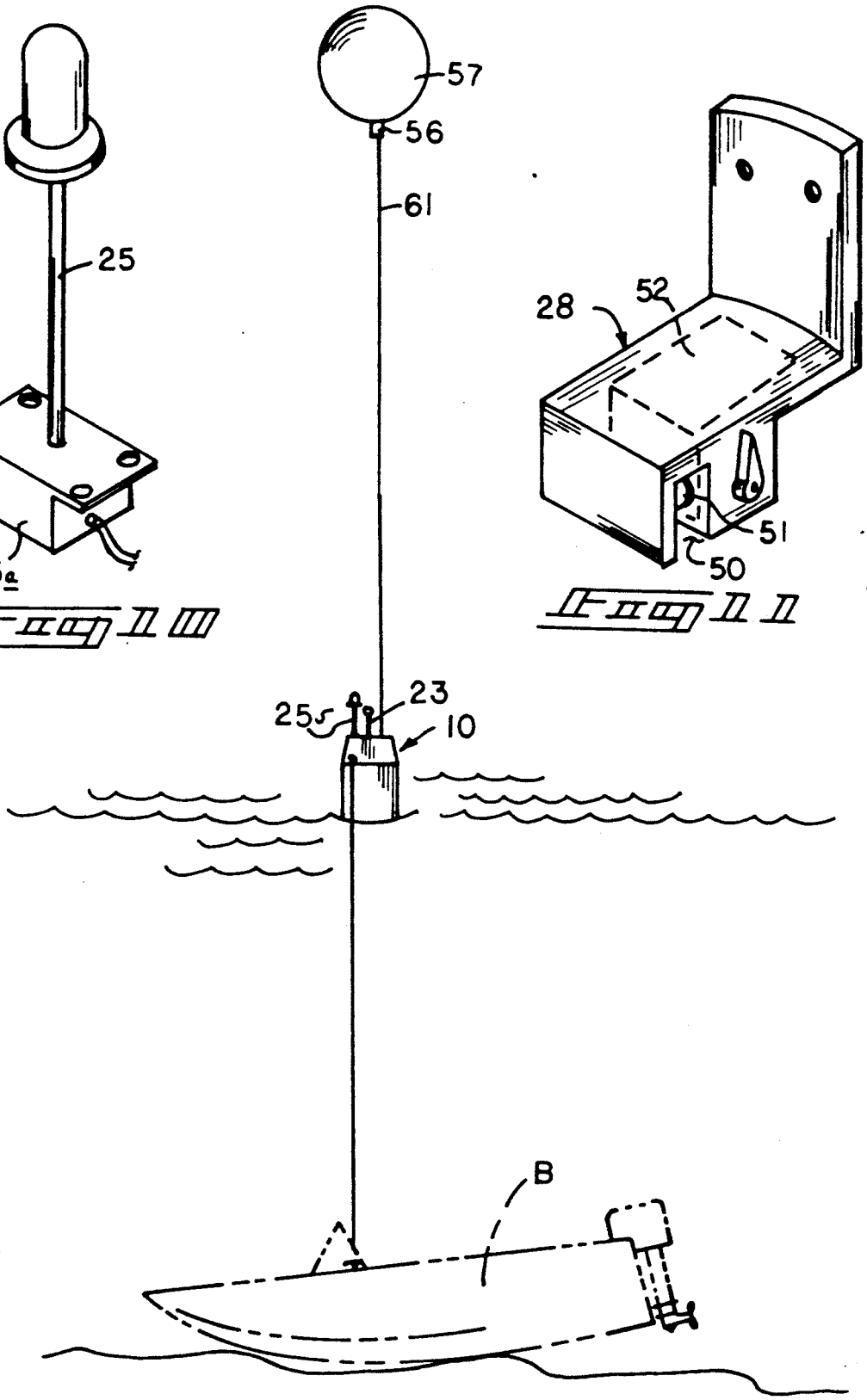

It should be noted, as illustrated in FIGS. 13 and 11, that a spool brake 28 is mounted within the lower housing cavity 14 and aligned, wherein a spool brake groove 50 rotatably receives a spool flange 18 of the spool 16. A piston 51 positioned within the groove 50 is operative through a solenoid and relay 52 to effect projection of the piston 51 to effect frictional engagement with the spool flange 18 upon actuation of a switch member 29, in a manner to be discussed below, to provide a constant frictional engagement permitting a metered rotation of the spool 16 providing a controlled release of the tether line 17 from the spool 16 preventing its breakage during release.

A radio transmitter 22 is mounted to the intermediate floor plate 20 and operative through a radio antenna 23 to effect transmission of a radio signal upon actuation of the switch assembly 29.

Figure 4:
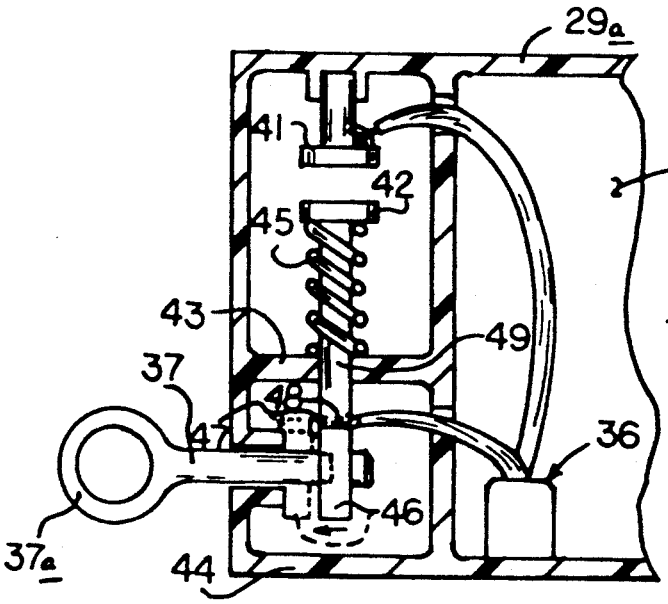
FIG. 4 is an orthographic view, taken along the lines 4—4 of FIG. 3 in the direction indicated by the arrows.
Figure 8:
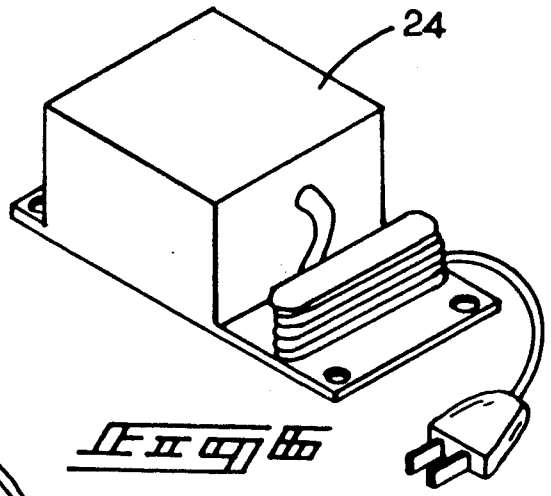
FIG. 8 is an isometric illustration of an inflation chamber utilized by the invention.
Figure 7:
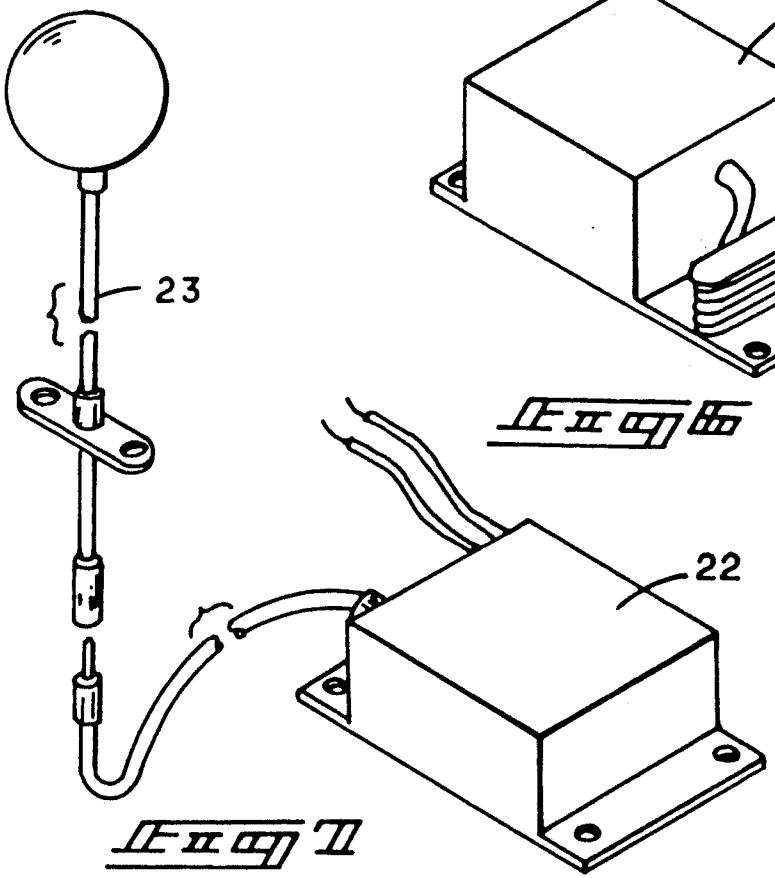
FIG. 7 is an isometric illustration of a radio transmitter utilized by the invention.
Figure 5:
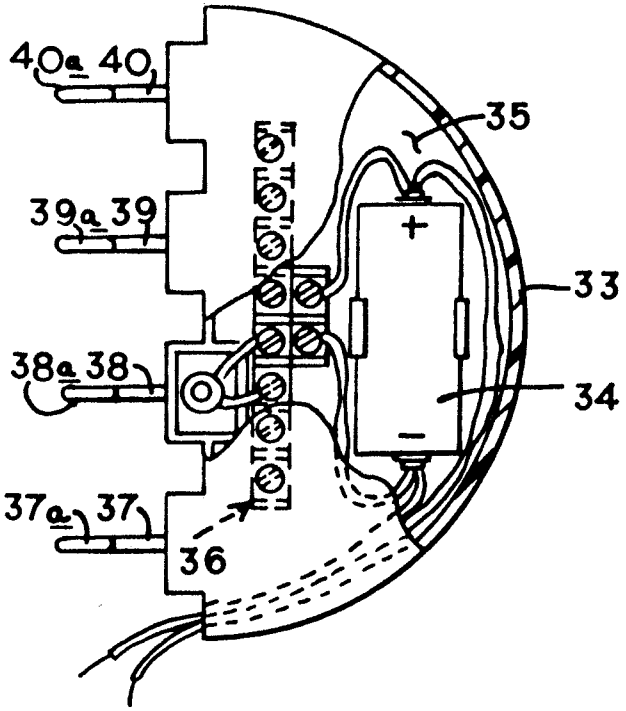
FIG. 5 is an orthographic top sectional view of the switch member, as illustrated in FIGS. 3 and 4.

An A-C/D-C convertor 24 is provided to provide for recharging of a battery 34 (see FIG. 5 for example) during maintenance of the apparatus 10 prior to its positioning within the boat "B". The convertor 24 is operative in a conventional manner to effect charging of the battery 34. An illumination light member 25, as well as the radio transmitter 22, are mounted to the upper housing roof plate 27 in a generally orthogonal relationship, wherein the light member 25 includes a flasher unit 25*a* mounted fixedly to a shaft support in the illumination light member 25 to effect its selective illumination in a flashing manner. The switch assembly 29 includes a housing to include a roof 29*a*, with a rear wall 33 and a floor. The switch assembly includes a switch assembly cavity 35 receiving the battery 34 and a wiring harness assembly 36 cooperative with the plurality of switches defined within the switch assembly 29, wherein the switch assemblies include a first switch rod 37 cooperative with a first switch, a second switch rod 38 cooperative with a second switch, a third switch rod 39 cooperative with a third switch, and a fourth switch rod 40 cooperative with a fourth switch. Wiring from the wiring harness assembly 36 is directed through a wiring harness bore 32 with an intermediate floor plate 20 cooperative with the spool brake 28 and subsequently to the radio antenna 23, the illumination light member 25, and an inflation assembly to include an inflation balloon housing 26 that is mounted orthogonally within the upper roof plate 27. The switches each include a loop defined by a respective first, second, third, and fourth loop 37*a*, 38*a*, 39*a*, and 40*a*, each mounted to an exterior end portion of each respective first through fourth rod, as illustrated in FIG. 3 for example. The flexible tether line 17 is directed through each rod from the spool 16 and subsequently through the tether line upper housing guide bore 30 to the boat "B". The switch assembly 29 is diametrically mounted within the housing and on the intermediate floor plate 20 in an opposed relationship relative to the tether line upper housing guide bore 30, whereupon as the tether line 17 is directed exteriorly of the housing and as the housing is elevated upwardly relative to the boat "B", the first through fourth switch rods 37–40 are extracted exteriorly of the switch assembly housing to effect closure of each normally opened switch therewithin. FIG. 4 illustrates operation of each switch that includes a first electrical contact member fixedly mounted to the switch assembly roof 29*a*, with a second electrical contact member 42 reciprocatably mounted relative to a switch assembly intermediate web 43. The first and second contacts are in alignment relative to one another in a spaced relationship and maintained in that relationship by reception of a switch rod abutment plate lock rod 47 mounted within a switch rod abutment plate 46 that is orthogonally secured to an interior end portion of each respective switch rod. The lock rod 47 is slidably received within a lock rod receiving bore 48 within a second switch member rod support 49. Upon reciprocation exteriorly of the housing of each switch by the respective rod, such as a rod 37, the lock rod 47 is removed from the receiving bore 48 to permit the second contact member spring 45 captured between the switch assembly and intermediate web 43 and the second electrical contact member 42 to project a second electrical contact member 42 upwardly into electrical communication with the first contact member 41 effecting electrical communication of that switch and completion of that circuit to thereby power an associated organization, such as the transmitter 22 in use. The first switch rod 37 is operative to effect actuation of the inflation balloon assembly mounted within the inflation balloon housing 26. The second switch rod 38 is operative to effect actuation of the radio transmitter, the third switch rod 39 is operative to effect actuation of the light member 25, and the fourth switch rod 40 is operative upon extraction from the switch assembly housing to effect actuation of the spool brake 28.

The inflation balloon housing 26 includes a balloon housing lid 53 that projects above the upper housing roof plate 27. Within the housing 26 there is positioned a compressed balloon 57 that includes mounting to a nozzle 59, with a piercing spike 58 positioned medially of the nozzle 59. A helium compressed gas cylinder 55 is mounted within a yoke 56 that in turn is mounted to the nozzle 59 and piercing spike 58, whereupon projection of the cylinder 55 upwardly by actuation of the balloon solenoid piston 54 that in turn is actuated by a conventional solenoid upon closure of the first switch through the first switch rod 37, the compressed gas cylinder is punctured by the spike 58, wherein the compressed gas is directed through the nozzle 59 into the balloon 57, wherein an expansion of the balloon 57 inflates the balloon and rises upwardly as a visible signal, in a manner as illustrated in FIG. 12. A balloon tether line 61 is wound about a balloon spool 60, whereupon the tether line 61 is secured to the yoke 56, whereupon rising of the balloon 57 tethers the balloon relative to the upper housing 12 to the balloon tether line 61.

The diagrammatic illustration of FIG. 2 illustrates the orientation of each switch and the respective contact members. The phantom representation indicates by way of example that the remaining switches are merely positioned in series with the transmitter organization and operative in a like manner.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A rescue buoy apparatus, comprising in combination, a lower housing selectively securable to an upper housing, the lower housing including a lower housing cavity, the lower housing cavity including a spool member rotatably mounted within the lower housing cavity, the spool member including an elongate flexible tether line wound about the spool member, and an intermediate floor plate mounted between the upper housing and the lower housing, and fastener means mounted to the upper housing and lower housing for securement of the upper housing to the lower housing for capturing the intermediate floor plate therebetween, and the intermediate floor plate including a switch assembly, and the intermediate floor plate further including a radio transmitter, and the upper housing including an upper housing roof, the upper housing roof including a radio antenna fixedly mounted thereto, with the radio antenna projecting exteriorly of the upper housing in electrical communication with the radio transmitter and the switch assembly, and the elongate flexible tether line mounted to the switch assembly, and the flexible tether line projecting exteriorly of the upper housing through a tether line upper housing guide bore, whereupon projection of the flexible tether line exteriorly of the upper housing through the upper housing guide bore effects actuation of the switch assembly to effect actuation of the radio transmitter.

2. An apparatus as set forth in claim 1 including a spool brake mounted within the lower housing cavity, the spool brake including a spool brake groove, and a spool including at least one spool flange, the at least one spool flange rotatably positioned within the spool groove, and the spool brake including a piston, the piston reciprocatably positioned within the spool brake groove, and a solenoid means within the spool brake for effecting reciprocation of the piston within the groove for selective projection against the at least one spool flange to retard rotation of the spool.

3. An apparatus as set forth in claim 2 including an illumination light member mounted to an upper housing roof plate adjacent the radio antenna, and a flasher unit mounted in association with the illumination light member, and the flasher unit in electrical communication with the switch assembly, and the switch assembly operative to effect actuation of the illumination light member.

4. An apparatus as set forth in claim 3 including an inflation balloon housing mounted within the upper housing roof plate, the inflation balloon housing including a housing lid, the housing lid hingedly mounted to the inflation balloon housing above the upper housing roof plate, and a balloon positioned within the inflation balloon housing below the balloon housing lid, and the balloon including a yoke mounted to the balloon, the yoke including a helium gas cylinder mounted within the yoke, and the helium gas cylinder aligned with a nozzle, the nozzle positioned within the yoke and the balloon, and the nozzle including a piercing spike, and a balloon solenoid piston means positioned below the gas cylinder for effecting selective projection of the gas cylinder into the spike for effecting inflation of the balloon, and a balloon switch means mounted within the switch assembly for effecting selective actuation of the balloon solenoid piston, and a balloon spool mounted within the balloon housing, and the balloon spool including a balloon spool tether line wound thereabout, and the balloon spool tether line secured to the yoke for tethering the yoke and the balloon to the balloon housing upon inflation of the balloon.

5. An apparatus as set forth in claim 4 wherein the tether line upper housing guide bore is directed through the upper housing diametrically opposed to the switch assembly, and the lower housing including a plurality of guide loops, wherein the guide loops are aligned with the tether line upper housing guide bore, with the tether line directed through the guide loops for securement of an associated vessel.

6. An apparatus as set forth in claim 5 wherein the switch assembly includes a plurality of switch rods reciprocatably mounted within the switch assembly, each switch rod includes a loop, and each loop receiving the flexible tether line therethrough, and each switch rod includes a switch rod abutment plate positioned within the housing, and the switch assembly includes a switch assembly roof positioned above the switch rod abutment plate, and the switch assembly roof including a first electrical contact member, and a second contact member mounted between the first electrical contact member and the switch rod abutment plate, and a spring member mounted to the second electrical contact member to effect biasing of the second electrical contact member to the first electrical contact member, and each second electrical contact member includes a second switch member rod support, and each rod support receives a spring thereabout, and a lower terminal end of the rod support includes a receiving bore, and the abutment plate includes a lock rod mounted thereon, with the lock rod slidably received within the lock rod receiving bore, whereupon reciprocation of the switch rod relative to the second switch member rod support effects removal of the lock rod relative to the lock rod receiving bore and effects projection of the second electrical contact member to the first electrical member.

* * * * *